United States Patent [19]

Bahre et al.

[11] 4,025,117

[45] May 24, 1977

[54] COAL PLANER

[75] Inventors: Karl Bahre, Gladbeck; Hans-Dieter Nowak, Herne, both of Germany

[73] Assignee: Klockner-Werke AG, Duisburg, Germany

[22] Filed: Mar. 24, 1976

[21] Appl. No.: 670,173

[30] Foreign Application Priority Data

Apr. 4, 1975 Germany ..... 2514726

[52] U.S. Cl. ..... 299/34

[51] Int. Cl.[2] ..... E21C 27/35

[58] Field of Search ..... 299/32, 34

[56] References Cited

UNITED STATES PATENTS 3,445,138 5/1969 Lobbe et al. ..... 299/34

FOREIGN PATENTS OR APPLICATIONS 1,188,254 4/1970 United Kingdom ..... 299/34

*Primary Examiner*—Ernest R. Purser

*Attorney, Agent, or Firm*—Michael J. Striker

[57] ABSTRACT

A coal planer for use in an underground mine gallery comprises a central unit, a pair of loading heads arranged spaced from and to opposite sides of the central unit and a pair of intermediate units respectively located between the central unit and the loading heads and linked to the latter and the central unit. Each of the intermediate units is provided with a plurality of planing knives arranged vertically spaced from each other for cutting coal from the mine face during reciprocation of the coal planer in a direction parallel to the mine face, and with a bottom knife adapted to cut into the sole of the mine gallery.

13 Claims, 5 Drawing Figures

COAL PLANER

BACKGROUND OF THE INVENTION

The present invention relates to a multilink coal planar which has a pair of intermediate units located between a central unit and loading heads, in which each of the intermediate units basically comprises a base plate and a support with a plurality of planing knives and a bottom knife.

The intermediate units of coal planers of the aforementioned kind have a plurality of planing knives and a bottom knife. The planing knives are connected each with a carrier which in turn is connected to the support of the intermediate unit. In this construction the planing knives are fixedly connected to the intermediate unit. This will result that during movement of the coal planer in a direction opposite to the planing direction, the back faces of the planing knives will slide on the mine face to remove in an undesired manner fine coal or coal dust therefrom. In addition, the planing knives will be heated due to the frictional engagement with the mine face in an undesired manner and sometimes torn from the knife carrier. Furthermore, to overcome the friction between the knives and the mine face, the drive reciprocating the coal planar along the mine face has to be constructed for a higher output than would be necessary when such friction losses could be avoided.

The same disadvantages are inherent with the bottom knife on the intermediate units of known coal planers, since such bottom knives will, during movement of the coal planer in a direction opposite its planing movement, slide on the sole of the mine gallery and on the mine face, whereby again fine coal or coal dust will be created in an undesired manner and the bottom knife will be heated during such sliding movement. At the same time the power of the drive has likewise to be increased.

SUMMARY OF THE INVENTION

It is an object of the present invention to provide a multi-link coal planer of the aforementioned kind which avoids the disadvantages of such coal planers known in the art.

It is a further object of the present invention to provide a coal planer for efficiently mining coal in an underground mine gallery in which production of fine coal and dust is avoided, in which energy losses due to friction are reduced and the useful life of the knives is increased. To obtain these results the cutting edges of the knives have to dig in working position into the coal seam during movement in one direction of the coal planer along the mine face and these knives have to be tilted during the movement in the opposite direction along the mine face to disengage the knives from the latter.

With these and other objects in view, which will become apparent as the description proceeds, the planing knives of the intermediate units of the coal planer and the bottom knife are mounted on a support of the intermediate unit movable between two end positions and in which each planing knife is movable along a path extending inclinded to the direction of reciprocation of the coal planer and parallel to the sole of the mine gallery, whereas the bottom knife thereof is mounted on the support for movement along a path inclined to the aforementioned direction and inclined to the sole of the mine gallery.

In the working position of the planing knives and the bottom knife these knives will penetrate into the coal seam, whereas in an inactive position thereof, that is when the coal planer is moved in a direction opposite to its planing direction, these knives will be disengaged from the mine seam.

The planing knives are removably mounted on the support and a replacement of the planing knives can be carried out at any position of the coal planer in the mine gallery.

The coal planer according to the present invention will result in a reduction of friction, and a corresponding reduction of the force necessary to move the coal planer along the mine face. The production of fine coal will be essentially reduced and the useful life of the coal planer will be increased due to the reduction of wear on the knives thereof.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
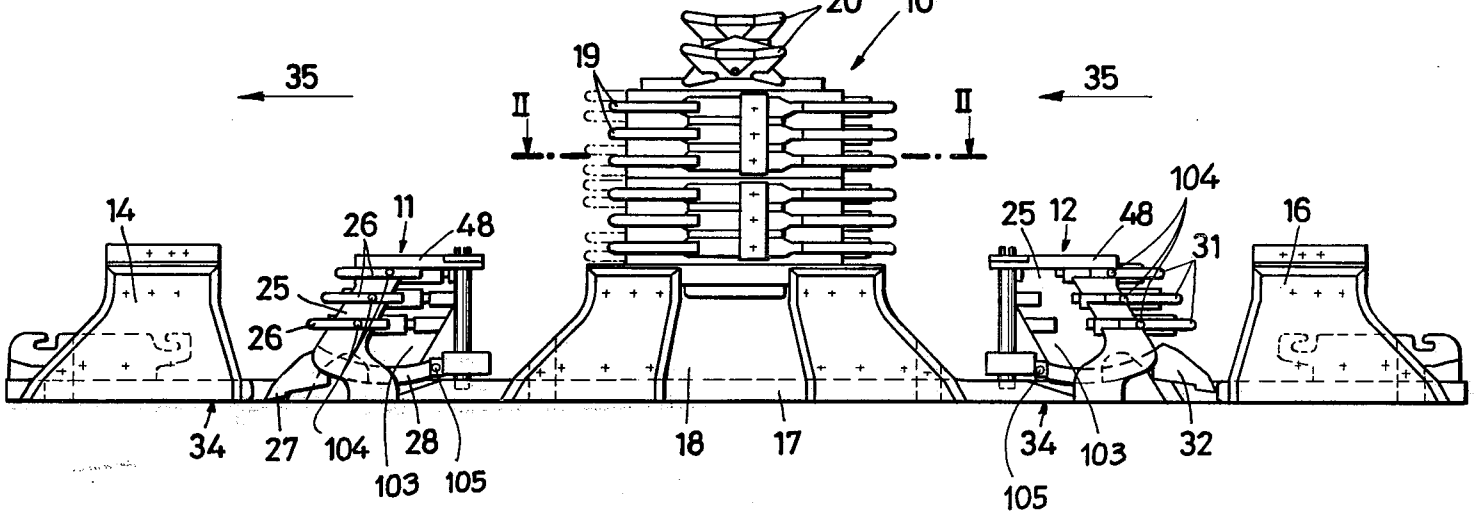
FIG. 1 is a front view of the mining apparatus according to the present invention, as seen from the mine face.
Figure 2:
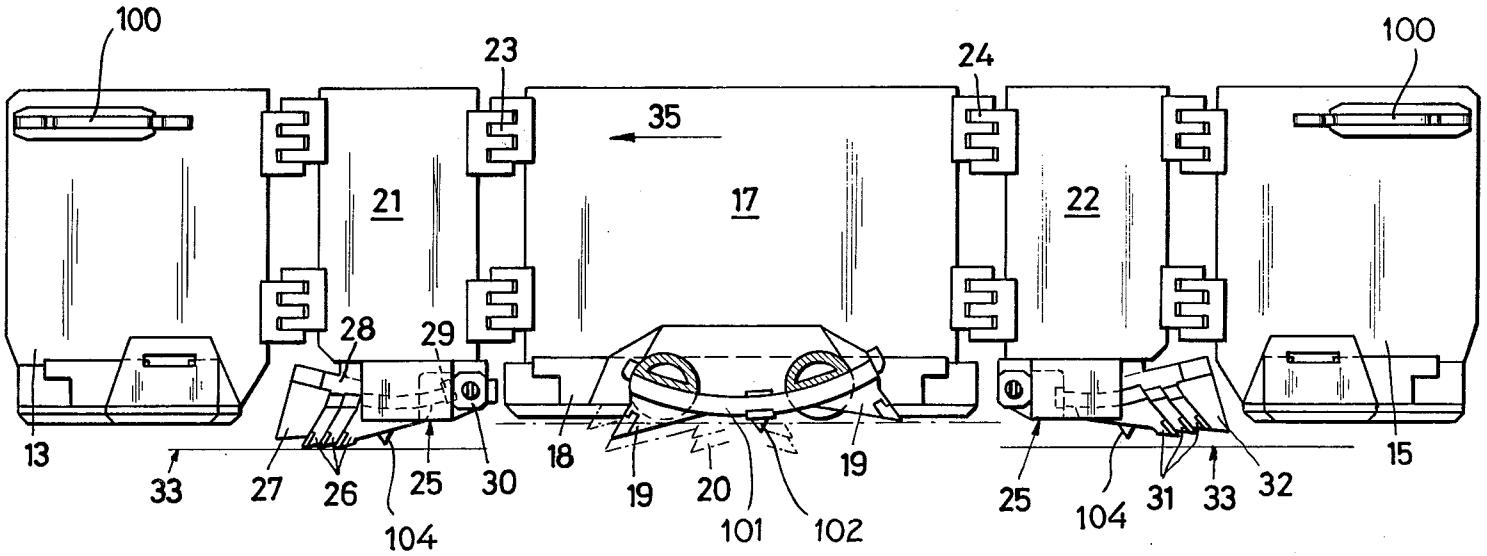
FIG. 2 is a top view of the mining apparatus shown in FIG. 1.

The coal planer illustrated in FIGS. 1 and 2 comprises a plurality of units, that is a central unit 10, a pair of intermediate units 11 and 12 arranged to opposite sides of the central unit 10, as well as a loading head 14 arranged on a bottom plate 13 located laterally of the unit 11 and a second loading head 16 on a bottom plate 15 arranged laterally of the intermediate unit 12. The central unit 10 comprises a bottom plate 17 onto which a support 18 is mounted. Depending on the height of the coal seam to be mined a plurality of planing knives 19 are mounted spaced in vertical direction from each other on the support 18 of the central unit 10 and this unit carries also upwardly extending roof knives 20 adapted to remove coal from the coal seam immediately below the mine roof. Normally the mine roof is not engaged by the knives 20.

The bottom plate 17 of the central unit 10 is connected by links 23 and 24 to the bottom plates 21 and 22 of the intermediate units 11 and 12 and similar linkages connect the bottom plates 21 and 22 to the plates 13 and 15 on which the loading heads 14 and 16 are respectively mounted. The plates 13 and 15 also carry hooks 100 to which means of known construction, not shown in the drawing, are to be connected for reciprocating the coal planer parallel to the mine face. Each of the intermediate units 11 and 12 comprises an upright support 25 connected to the portion of the respective bottom plates 21 and 22 which faces the mine face 33 on which the planing knives 26, respectively 31, and a bottom knife 27, respectively 32, are movably mounted. Assuming the coal planer is moved in the direction as indicated by the arrows 35, the planing knives 26 of the intermediate unit 11 are in the working position engaging the mine face to remove coal therefrom, and the bottom knife 27 of the intermediate unit 11 is in engagement with the floor 34 of the mine gallery. In the intermediate unit 12, however, the planing knives 31 and the bottom knife 32 are in inactive position during movement of the coal planer in the direction of the arrow 35, that is the planing knives 31 are disengaged from the mine face 33, whereas the bottom knife 32 is raised above the sole 34.

Figure 3:
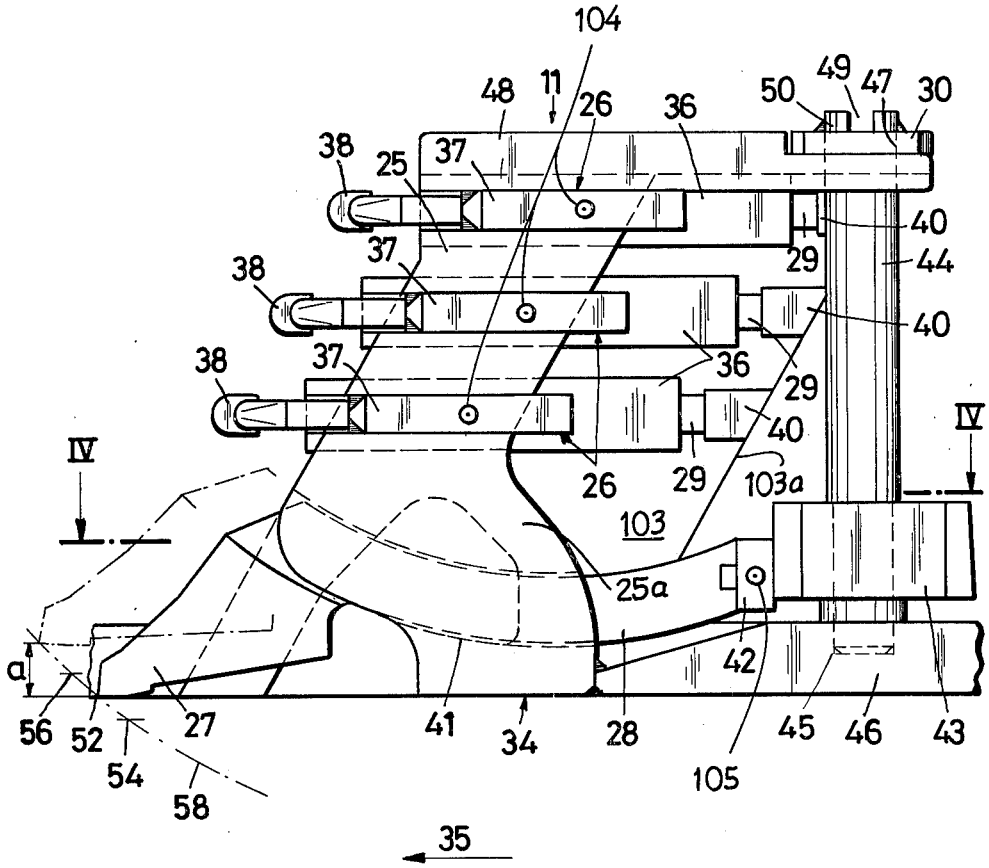
FIG. 3 is an enlarged front view of one intermediate unit of the mining apparatus of FIG. 1.

FIG. 3 illustrates the intermediate unit 11, as seen from the mine face, at an enlarged scale, as compared to that in which this unit is shown in FIG. 1. The support 25 of each intermediate unit comprises a rear plate 103 having an inclined rear edge 103*a* and a front member 25*a* provided with guide grooves for guiding bar-shaped carriers 36 for the planing knive blades 38. Each of the carriers 36 has a holding portion 37 of reduced width projecting forwardly from the respective carrier 36 through an open slot in the front member 25*a*. Each of the knife blades 38 abuts with a rear end thereof against the front end of this holding portion and is connected thereto and to the carrier member 36 in any convenient manner. Each of the bar-shaped carriers 36 is provided, at the end opposite from the end from which the knife blade 38 projects, with a nose 29 which will engage, when the unit 11 moves in the direction of the arrow 35, with a rear face thereof a respective abutment 40 fixedly connected to the plate 103 and projecting forwardly from the rear edge 103*a* thereof, to hold the knife blade thereon in working position. The bottom knife 27 is connected to one end of a curved shaft 28 guided in appropriate curved guide grooves 41 provided in the member 25*a*, and on its rear end, shown as the right end in FIG. 3, the shaft 28 is provided with an abutment 42. A polygonal member 43 arranged closely adjacent to the abutment 42 is fixedly mounted in the region of the lower end of an adjusting bolt 44, the lower end of which is turnably mounted in a blind bore 45 provided in an extension 46 of the bottom plate 21 or 22 of the respective intermediate unit, whereas the upper end of the bolt 44 extends through a bore 47 in a top plate 48 connected to the upper end of the plate 103 and projecting forwardly therefrom. To facilitate turning of the bolt 44, the upper end 50 thereof is provided with a slot 49 in which an appropriate tool may be inserted for turning the bolt 44 about its axis.

Figure 4:
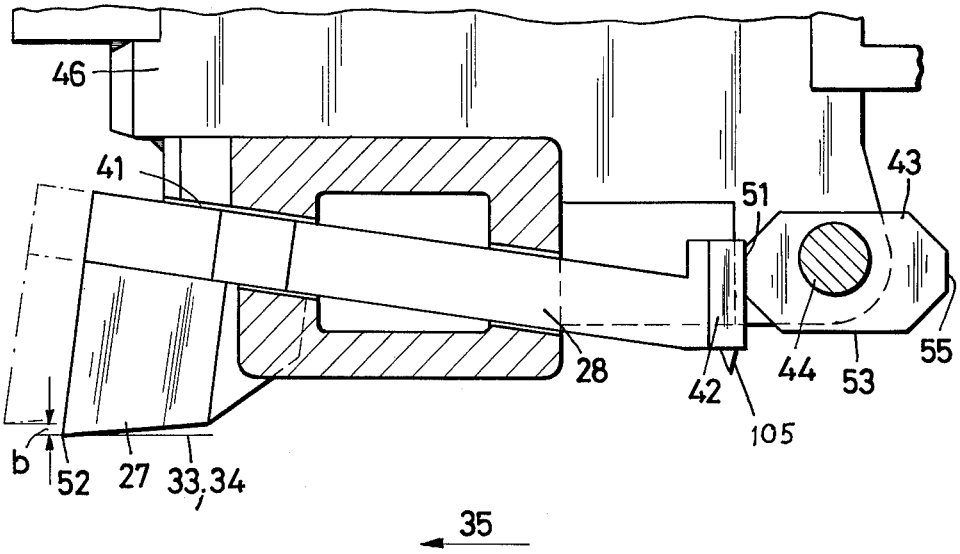
FIG. 4 is a cross-section taken along the line IV—IV of FIG. 3.

As shown in FIG. 4 the bolt 44 is arranged eccentrically with respect to the polygonal member 43. In the position as shown in FIG. 4 the abutment 42 on the shaft 28 abuts against the side face 51 of the polygonal member 43 so that a point 52 of the bottom knife 27 will just touch the sole 34 and the face 33 of the mine gallery.

When the polygonal member 43 is now turned by the bolt 44 so that its face 53 will be opposite the abutment 42, the abutment 42 can move towards the right, as viewed in FIGS. 3 and 4, so that the point 52 of the bottom knife will move to the position 54 indicated in FIG. 3 to thereby remove part of the sole of the mine gallery during movement of the intermediate member 11 in the direction of the arrow 35.

When the polygonal member 43 is turned so that the abutment 42 will engage the side face 52 of the polygonal member 43, the point 52 will be raised to the position 56 indicated in FIG. 3 to thereby leave part of the coal on the sole of the mine gallery. The point 52 of the bottom knife 27 can therefore be moved between a plurality of positions along an arc 58 indicated in FIG. 3.

In order to prevent undesired turning of the bolt 44 and the polygonal member 43 fixed thereto, a preferably square plate 30 is fixedly connected to the upper end of the bolt 44 with one face thereof adapted to abut against an adjacent projection on the plate 48. In order to permit turning of the bolt 44 the latter has therefore to be lifted, for instance manually by the operator or by any other known means connected to the bolt, for a distance at least equal to the thickness of the plate 30.

FIGS. 3 and 4 show in dashed lines the position which the bottom knife 27 will assume when the intermediate unit 11 is moved in a direction opposite to the planning direction, that is in a direction opposite to the direction indicated by the arrow 35. As shown in FIG. 3, the bottom knife 27 is lifted from the sole of the mine gallery, whereas FIG. 4 indicates that the bottom knife 27 is simultaneously moved away from the mine face 33. The maximum distance of the bottom knife from the sole of the mine gallery is indicated with *a* and the distance of the bottom knife from the mine face is indicated with *b*.

Figure 5:
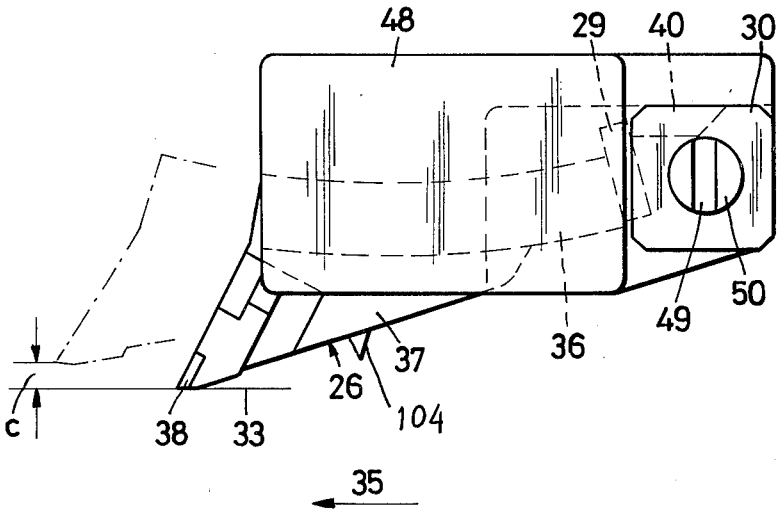
FIG. 5 is a top view of FIG. 3, in which only the uppermost of the planing knives is shown.

In the top view of the intermediate unit 11 shown in FIG. 5, one of the planing knives 26 is shown in working position in which the knife blade 38 penetrates into the mine face and carries out a planning of the coal therefrom. If the intermediate unit 11 is moved in a direction opposite to the direction indicated by the arrow 35, thas is towards the right, as viewed in FIG. 1, then the knife blade 38 will move to the position indicated in dash--dotted lines in FIG. 5, so that the cutting edge thereof will be spaced for the distance *c* from the mine face 33.

Conical spikes 104 are connected to the members 37 projecting laterally therefrom, so that when the intermediate unit 11 is moved in a direction opposite to that indicated by the arrow 35, the points of the spikes 104 will come into engagement with the mine face. The friction force resulting therefrom will assure that the members 37 and 36 as well as the knife blades 38 carried thereby will be moved towards the left, as viewed in FIG. 3. In this way, the knife blades 38 will be moved away from the mine face to the position as indicated in dash-dot lines in FIG. 5. SImilar spikes 105 are also connected to the abutment 42 on the rear end of the shaft 21 for the bottom knives 27 and 32 to move the latter to the position as indicated in dash-dot lines in FIG. 3. However, such spikes are not absolutely necessary, since during movement of the intermediate unit 11 in direction opposite to the direction indicated by the arrow 35, the knife blades 38 and the bottom knife 27 will become automatically disengaged from the mine face, respectively the sole of the mine gallery.

The knives 19 of the central unit 10 are mounted on opposite ends of the curved members 101 which in turn are movably guided in longitudinal direction in appropriate guide grooves of upright supports 106. A conical spike 102 is provided on a central portion of each member 101 for the purpose as described in connection with the spikes 104 and 105 and enlarged base portion of the spike forms at the same time a stop adapted to abut against either of the upright supports 106 to thereby limit movement of the member 102 in one or the other direction.

It will be understood that each of the elements described above, or two or more together, may also find a useful application in other types of coal planers for mining coal in an underground mining gallery differing from the types described above.

While the invention has been illustrated and described as embodied in a coal planer for mining coal in an underground mining gallery, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A coal planer for mining coal in an underground mine gallery having a sole, a mine face and a ceiling, said coal planer being reciprocable on the sole of the mine gallery in a direction parallel to the mine face and comprising a central unit; two loading heads arranged spaced from and respectively at opposite sides of said central unit; and two intermediate units respectively located between said central unit and said loading heads and linked to the latter and to said central unit, each of said intermediate units comprising a base plate, upright support means connected to said base plate, a plurality of planing knives arranged on said support means, each movable relative said support means along a path extending inclined to said direction and parallel to the sole of the mine gallery between a working position and an inactive position for cutting, in said working position, coal from the mine face, and a bottom knife mounted on said support means for movement relative said support means along a path which is inclined to said direction and is also inclined to the sole of the mine gallery, so that said bottom knife moves between a working position in which said bottom knife engages the mine face and also engages the sole of the mine gallery and an inactive position in which said bottom knife is disengaged from both the mine face and the sole of the mine gallery.

2. A coal planer as defined in claim 1, and including a plurality of elongated knife carrier means, one for each planing knife, said support means being provided with guide means in which said knife carrier means are respectively arranged for movement in longitudinal direction.

3. A coal planer as defined in claim 2, wherein said guide means are curved and respectively arranged in planes substantially parallel to the sole of the mine gallery.

4. A coal planer as defined in claim 2, wherein each planing knife projects beyond one end of its carrier means, each of said carrier means having a nose on its other end, and including an abutment for each carrier means fixed to said support means, against which said nose on said carrier means abuts in the working position of the respective planing knife.

5. A coal planer as defined in claim 1, and including a base plate for each loading head and said central unit, said base plate of each intermediate unit being linked for tilting movement about substantially horizontal axes to the base plate of the adjacent loading head and that of the central unit.

6. A coal planer for mining coal in an underground mine gallery having a sole, a mine face and a ceiling, said coal planer being reciprocable on the sole of the mine gallery in a direction parallel to the mine face and comprising a central unit; two loading heads arranged spaced from and respectively at opposite sides of said central unit; and two intermediate units respectively located between said central unit and said loading heads and linked to the latter and to said central unit, each of said intermediate units comprising a base plate and provided with a curved guide, upright support means connected to said base plate, a plurality of planing knives arranged on said support means, each movable along a path extending inclined to said direction and parallel to the sole of the mine gallery between a working position and an inactive position for cutting, in said working position, coal from the mine face, and a bottom knife mounted on one end of a curved shaft guided in said curved guide of said support means for movement along a curved path inclined to said direction and inclined to the sole of the mine gallery, said path being arranged in a plane extending inclined to the mine face and normal to the mine sole.

7. A coal planer as defined in claim 6, wherein said curved path is a path consitituting part of a circle.

8. A coal planer as defined in claim 6, and including an abutment on the other end of said shaft.

9. A coal planer as defined in claim 8, and including a polygonal member adjacent said abutment on the other end of said shaft, an adjusting bolt turnably mounted on said support means and carrying said polygonal member for turning movement therewith, said polygonal member having a plurality of faces extending parallel to the axis of said bolt, said abutment on said shaft abutting during movement of said coal planer in one direction of its reciprocation against one of said faces to thereby hold said bottom knife in a predetermined position relative to the sole of the mine gallery.

10. A cold planer as defined in claim 9, wherein said adjusting bolt passes eccentrically through and with portions thereof to opposite sides of said polygonal member, said base plate being provided with a bore in which one of said portions of said bolt is turnably. mounted.

11. A coal planer as defined in claim 10, and including means for preventing undesired turning of said adjusting bolt and said polygonal member connected thereto.

12. A coal planer as defined in claim 11, wherein said means for preventing undesirable turning of said bolt comprise a plate having a side face fixed to the other end of said bolt, and abutment means fixed to said support means and normally abutting against said side face of said plate, said bolt together with said polygonal member and said plate being shiftable in axial direction of said bolt to permit turning of the latter and said polygonal member fixed thereto.

13. A coal planer as defined in claim 9, and including a conical spike projecting in a direction transverse to said shaft from the region of the other end of the latter and adapted to engage said mine face during movement of said coal planer in a direction opposite to said one direction to thereby lift said bottom knife from the sole of the mine gallery and to disengage said abutment on the other end of said shaft from the corresponding face of the polygonal member.

* * * * *